US005542283A

United States Patent [19]

Post

[11] Patent Number: 5,542,283

[45] Date of Patent: Aug. 6, 1996

[54] BENDING MACHINE

[76] Inventor: Friedhelm Post, Hornberg 20, 79737 Herrischried, Germany

[21] Appl. No.: 158,622

[22] Filed: Nov. 24, 1993

[30] Foreign Application Priority Data

Dec. 3, 1992 [DE] Germany ..... 42 40 725.7

[51] Int. Cl.[6] ..... B21J 9/18; B21J 13/04; B21D 7/00

[52] U.S. Cl. ..... 72/446; 72/384; 72/403; 72/472; 83/499

[58] Field of Search ..... 72/384, 446, 403, 72/407, 472, 449; 83/499

[56] References Cited

U.S. PATENT DOCUMENTS

| | | | |
|---|---|---|---|
| 4,502,314 | 3/1985 | Wunsch | 72/384 |
| 4,581,917 | 4/1986 | Moriyama et al. | 72/446 |
| 4,607,517 | 8/1986 | Finzer et al. | 72/384 |
| 4,708,009 | 11/1987 | Post | 72/446 |
| 5,216,913 | 6/1993 | Post | 72/472 |

FOREIGN PATENT DOCUMENTS

| | | |
|---|---|---|
| 3523828 | 8/1986 | Germany . |
| 4021346 | 7/1991 | Germany . |

*Primary Examiner*—David Jones
*Attorney, Agent, or Firm*—Flynn, Thiel, Boutell & Tanis, P.C.

[57] ABSTRACT

In a bending machine for wire or strip materials comprising a machine body (1) defining a work face (2) and having disposed thereon at least one planar and undercut guide path (F1 to F3) for tool mounting carriages (S1 to S4) mounted thereon for displacement therealong at least between operating positions by means of a selectively remote-controlled displacement drive system (7) and for being locked on said guide path in the selected operating position, each tool mounting carriage (S1 to S4) defining an operating axis (A1 to A4) extending substantially perpendicular to the respective guide path, and being provided with a tool carrier (6) mounted for displacement along the operating axis (A1 to A4) by means of an operating actuator (5), at least one guide path (F1, F2, F3) is formed with an arcuate curvature in the guide plane, the curvature preferably following a circular arc (K), and the concave side of the curvature facing towards a material feed axis (3).

20 Claims, 1 Drawing Sheet

BENDING MACHINE

FIELD OF THE INVENTION

The invention relates to a bending machine for bending elongated workpieces such as wire or metal strips.

BACKGROUND OF THE INVENTION

A wire bending machine typically has a number of bending tools each of which is movably mounted to a frame by a separate tool mounting cartridge.

In the case of a bending machine known from DE-PS 35 23 828, the guide paths for the tool mounting carriages disposed on opposite sides of the material feed axis are defined by planar and rectilinear prismatic bars secured to the machine body and extending parallel to the material or wire feed axis. The tool mounting carriages are linearly displaced between their operating positions and then locked in place. While the downtimes for the adjustment of the tool mounting carriages in this bending machine are advantageously short, the tools carried by the tool mounting carriages cannot be positioned as closely to one another as would be desirable for certain bending programmes. This is because the minimum distance between the tools in the direction of adjustment is determined by the width of the tool mounting carriages.

The same problem is encountered in the case of a bending machine known from DE PS 40 21 346, in which the adjustment downtimes are still further shortened, and the accuracy of the tool mounting carriage adjustment is improved by the employ of a computer-controlled adjustment drive system. Even in the case of extremely slim tool mounting carriages, the minimum spacing between adjacent tools is still determined by the width of the tool mounting carriages.

In addition, both of the two bending machines mentioned above require highly complicated technical structures for enabling a wire or strip material to be bent beyond an angle perpendicular to the material feed axis. This is because the operating axis of each tool mounting carriage extends perpendicular to the material feed axis, so that it is impossible to produce bending stroke components in directions oblique to the material feed axis.

SUMMARY OF THE INVENTION

It is an object of the invention to provide a bending machine of the type defined in the introduction, which permits narrow spacings between adjacent tools to be obtained irrespective of the width of the tool mounting carriages and/or allows the tools to be moved obliquely of the material feed axis, e.g. for acute angle bending operations, while retaining the advantage of short downtimes for the adjustment of the tool mounting carriages.

This object is attained by providing a bending machine that includes curvilinear guide members for carrying the tools.

Thanks to the curvature of the guide path, the minimum distance between the tools of adjacent tool mounting carriages is no longer determined by the width of the tool mounting carriages. It is additionally possible to obtain obliquely directed stroke components of the tool carriers, or tools, respectively, for acute angle bending operations. These advantages are obtained in unison with desirably short adjustment downtimes, since the adjustment drive system permits the tool mounting carriages to be continuously and rapidly displaced between their operating positions, and optionally a rest position, and that regardless of whether a change of the operating position requires a displacement of just a few tenths of a millimeter or a stroke of considerable length. A suitable selection of the curvature enables any tool mounting carriage to operate at one and the same bending location along the material feed axis from different operating positions on the guide path, thus permitting different oblique stroke components in opposite directions of the material feed axis to be obtained for the performance for instance of acute angle bending operations.

From so-called centerwheel bending machines it is in fact known to provide a circular carrier base for tool mounting carriages with mounting locations for the tool mounting carriages at predetermined circumferential spacings. For changing the operating position of any tool mounting carriage, however, the latter has to be dismounted from the carrier and remounted thereon at the new position.

Particular advantages are obtained by providing the bending machine with a plurality of curvilinear guide paths disposed around the material feed axis because each tool mounting carriage has its operating axis directed radially onto the center of the imaginary circle.

Likewise advantageous is the feature providing two curvilinear guide paths, one on each side of the material feed axis inasmuch as it permits the tool mounting carriages on both sides of the material feed axis to be adjusted in such a manner that the tools are enabled to operated closely adjacent one another and/or to obtain oblique stroke components. The guide plane may extend parallel to the work surface, it being absolutely possible for the guide plane of one guide path to extend at a higher or lower level—with respect to the working surface—than the guide plane of another guide path.

Positioning and forming the opposed guide members so that their axes of curvature are centered on the opposed sides of the material feed axis relative to their own position is particularly advantageous in view of obtaining minimum spacings between adjacent tools.

The invention advantageously permits a plurality of bending stations to be served in a simple manner. The radius of the circular arc may be of relatively great length, resulting in a weak curvature of the guide path. This does still allow the tools to be placed more closely adjacent one another, and with oblique stroke components, than would otherwise be determined by the width of the tool mounting carriages.

By providing the guide members with a prismatic dove tail or T-shaped cross sections, the bending machine has an advantageously simple and sturdy construction, resulting in accurate placement and stable retention under load of each tool mounting carriage. Also facilitated is the smooth displacement of the tool mounting carriages.

Functional simplicity and reliability in operation are offered by the bending machine of this invention. For its displacement either to a new operating position or to a rest position, a tool mounting carriage is simply coupled to the conveyor element, and uncoupled therefrom on reaching the desired position.

Still another advantage of this invention that the operating actuator of the tool mounting carriage is used in addition for the coupling and uncoupling operations.

Still another construction of this invention also offers the advantages of a simple construction in which the tool carrier performs a dual function and is operable to couple the tool mounting carriage to the conveyor element.

Still another feature of this invention offers the particular advantage that the operating actuator is additionally used for operating the clamping device so as to not require any auxiliary actuators for the coupling and clamping operations. The system is suitably devised in such a manner that the operating actuators have supplementary stroke lengths which do not come into play during the normal operation of the tool carriers, so that there is no overlap of the operating function with the displacement and clamping functions, respectively.

BRIEF DESCRIPTION OF THE DRAWINGS

An embodiment of the subject matter of the invention shall now be described in detail with reference to the drawings, wherein.

DETAILED DESCRIPTION OF THE INVENTION

Figure 1:
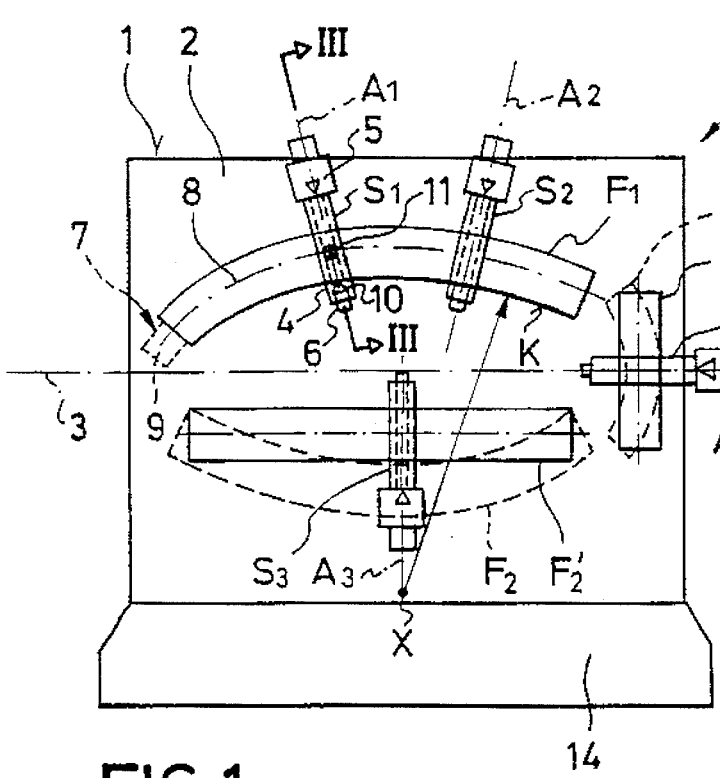
FIG. 1 shows a diagrammatic front elevation of a bending machine.
Figure 2:
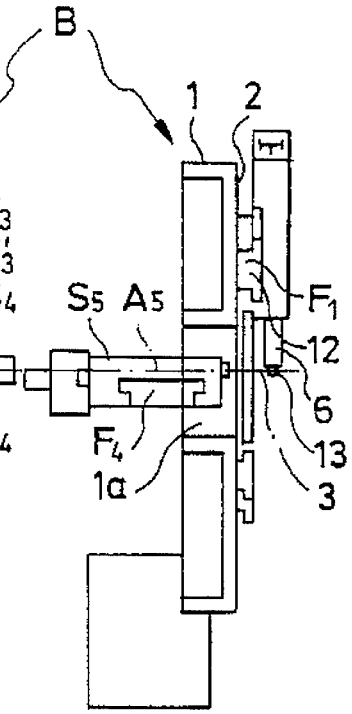
FIG. 2 shows a side elevation.

A bending machine B shown in FIGS. 1 and 2 has a machine body 1 defining an upright working face 2 and supported on a base 14. The bending machine B is used for being a wire-or strip-shaped material which is advanced along a horizontal material feed axis 3 in front of work face 2. Mounted on machine body 1 are planar guides F1 to F3 each formed of a length of a bar 12 having a prismatic section, dovetail section or T section. In a guide plane E (FIG. 3), i.e. parallel to work face 2, guide F1 is formed with a curvature K, having a circular arc having a center X located on the opposed side of the material feed axis 3 relative to the side of the axis on which it is located. More particularly, the center X is spaced away beyond the outer side of guide F2, that is the side of guide F2, that is distal from the of guide F2, that is the side of guide F2 distal from the material feed axis 3. Slidably mounted on guide F1 are several, for instance two, tool mounting carriages S1 and S2 each defining an operating axis A1 and A2, respectively, extending substantially perpendicular to a tangent with the curvature of guide F1 at the actual location of the respective tool mounting carriage S1, S2, and on the other hand substantially parallel to the work face 2 or the guide plane, respectively.

The tool mounting carriages S1, S2 are of substantially identical construction and need thus not be described separately. Tool mounting carriage S1 for instance comprises a housing 4 displaceably mounted on guide F1, and an operating actuator 5 for a tool carrier 6 mounted for displacement along operating axis A1 and having attached thereto a tool 13 (cf. FIG. 2) for working on the wire or strip material such as by bending, cutting, punching and the like.

Below material feed axis 3 in FIG. 1 is a rectilinear guide F2', with a further tool mounting carriage S3 defining an operating axis A3 slidably mounted thereon. As indicated with dotted lines, rectilinear guide F2' might also be replaced by a curvilinear guide F2 disposed similar to guide F1 with the concave side of its curvature K facing towards material feed axis 3. Curvilinear guide F2, like curvilinear guide F1, is shaped so that its center of curvature is located opposed side of the material feed axis 3 that the guide F2 itself is located on and, more particularly, beyond the outer side of opposed guide F1. To the right of guides F1 and F2, or F2', respectively, there is shown (in solid lines) a further rectilinear guide F3' extending substantially perpendicular to material feed axis 3 and carrying another tool mounting carriage S4 defining an operating axis A4. Instead of rectilinear guide F3' it would also be possible to provide a curvilinear guide F3 (indicated with dotted lines).

Guides F1, F2 and F3 may be disposed with the convex side of their curvature facing towards material feed axis 3. It is also possible to dispose one guide with its convex side and another guide with its concave side facing towards material feed axis 3. It is not either absolutely necessary that each guide be disposed approximately parallel to material feed axis 3. At least one of the guides might thus be turned in the plane of the drawing, so that one of its ends were disposed closer to the material feed axis than the other.

Indicated in FIG. 2 is a passage 1*a* through the center of machine body 1, to the rear of which there is provided a still further planar and rectilinear guide F4 for at least one further tool mounting carriage S5 defining an operating axis A5. The tools of the tool mounting carriages mounted on guide F4 cooperate from the rear of machine body 1 with the tools 13 of the tool mounting carriages S1 to S4 at the front of the machine body.

The guides F1, F2 and F3 indicated in FIG. 1 might also be interconnected to form a full circle, possibly provided with apertures at the intersections with the material feed axis. In this case all of the guides would have the same radius of curvature.

Provided within guide F1 (and similarly, although not shown within the remaining guides) is a displacement drive system 7 for tool mounting carriages S1, S2, comprising a drive source 9 and a conveyor element 8, which in the case of a pronounced curvature K would suitably follow the curvature, and in the case of a rather shallow curvature might follow a rectilinear path. As indicated with respect to tool mounting carriage S1, there is provided thereon a coupling fixture 11 selectively operable to engage conveyor element 8 for adjustable positioning of the carriages, and a clamping device 10 operable to clamp and lock the carriage on guide F1 in selected operating positions or in a rest position. For the operation of coupling fixture 11 and clamping device 10 there may be provided separate remotely controlled actuators. In a preferred embodiment, however, the operating actuator 5, and possibly the tool carrier 6 may be employed for performing these functions, as will be explained with reference to FIG. 3.

Figure 3:
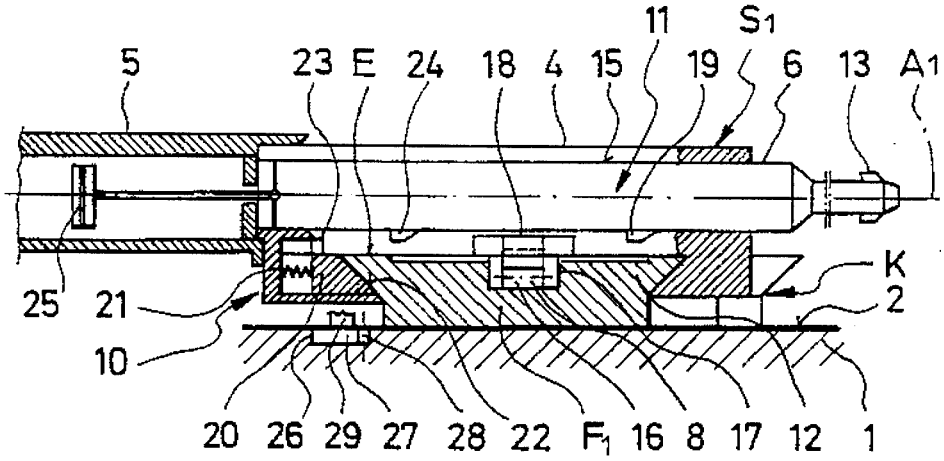
FIG. 3 shows a sectional view taken in the plane III—III of FIG. 1.

As shown in FIG. 3, guide F1 is in the form of a dovetail section bar 12 bolted or otherwise secured to work face 2 of machine body 1. Its top face defines the guide plane E for tool mounting carriage S1, and the curvature K of guide F1 lying in the guide plane E.

Within housing 4 of tool mounting carriage S1, tool carrier 6 is slidably guided in a longitudinal passage 15 defining operating axis A1. Operating actuator 5 is secured to housing 4 and comprises a hydraulic or pneumatic piston 25 which is coupled to tool carrier 6 for the back and forth displacement thereof. Conveyor element 8 is for instance a link chain or a timining belt or any other element capable of being moved along a curvilinear path, and is guided in a curvilinear groove 17 formed in section bar 12. Secured to conveyor element 8 is a coupling piece 18 formed with a detent (indicated by dotted lines) and adapted to be received in a recess formed in the bottom side of housing 4 transversely of the longitudinal direction thereof. Coupling piece 18 acts as part of the coupling fixture 11. Provided at the bottom side of tool carrier 6 is a key 19 acting as a coupling engagement member and adapted to be received in the detent of coupling piece 18 for coupling tool mounting carriage S1 to conveyor element 8. To this effect, piston 25 is activated to retract tool carrier 6 beyond the effective operating stroke of tool 13.

Clamping device 10 is accommodated in the rear portion of the housing 4 of tool mounting carriage S1. A clamp piece 20 is biased by a spring 21 into engagement with a complimentary surface of section bar 12 and has its top face provided with a projection 23 disposed in the displacement path of a key 24 on the bottom face of tool carrier 6. When tool carrier 6 is retracted beyond the effective operating stroke of tool 13 for coupling tool mounting carriage S1 to conveyor element 8, as explained above, key 24 acts to disengage clamp piece 20 from the complimentary face 22 while key 19 enters the detent of coupling piece 18. Tool mounting carriage S1 may then be adjusted along guide F1 by the operation of displacement drive system 7 including actuator 9 and conveyor element 8. After the new operating position has been reached, piston 25 is operated to displace tool carrier 6 with its keys 19 and 24 in the opposite direction to thereby re-engage clamp piece 20 with clamp face 22, and to subsequently disengage key 19 from the detent of coupling piece 18. Toll mounting carriage S1 is thus locked in the new operating position. Coupling piece 18 may be moved on to engage another tool mounting carriage, for example, tool mounting carriage S2, so that it can be appropriately repositioned. This feature of the invention thus provides a single displacement drive system 7 to be used to selectively and independently position multiple tool mounting carriages S1 and S2 mounted to a single guide F1.

Shown in FIG. 3 as an alternative to the displacement drive system with its conveyor element 8 disposed within the guide section bar 12 is a drive system comprising a conveyor element 27 disposed in a groove 26 formed in work face 2. Groove 26 may selectively follow the curvature K of guide F1 or be of rectilinear configuration. Conveyor element 27 may for instance be a curvilinear or rectilinear bar having one of its longitudinally extending sides formed as a tooth rack 28 adapted to cooperate with a not shown pinion of the displacement drive system 7. Diagrammatically indicated on the top face of conveyor element 27 is a pin 29 adapted to be coupled to tool mounting carriage S1 in the manner explained above or in any other suitable manner for the adjustment of tool mounting carriage along guide F1. For the displacement or adjustment of tool mounting carriage S1 it would also be conceivable to provide a separate actuator adapted to be activated independently of operating actuator 5 and cooperating with work face 2 and/or guide F1, for instance on the rack-and-pinion principle.

I claim:

1. A bending machine for selectively forming an elongated workpiece, said machine comprising:

a body having a face across which the workpiece is positioned along a longitudinally extending material feed axis, the material feed axis defining two opposed sides therealong;

a first guide member secured to said body face along a first side of the material feed axis, said guide member having a curvilinear profile and said first guide member being shaped to define a center of curvature located on a second side of the material feed axis, the second side being opposite the first side of the material feed axis; and at least one tool mounting carriage for carrying a workpiece forming tool, said at least one tool mounting carriage being mounted to said first guide member and being selectively positionable along the length of said first guide member.

2. The bending machine of claim 1, further including:

a second guide member secured to said body face along the second side of the material feed axis, said second guide member having an elongated profile and being attached to said body face so as to be substantially parallel to the material feed axis; and at least one tool mounting carriage for carrying a workpiece forming tool, said tool mounting carriage being mounted to said second guide member for being selectively positionable along the length of said second guide member.

3. The bending machine of claim 2, further including:

a plurality of tool mounting carriages mounted to said first guide member, each said tool mounting carriage being selectively positioning along the length of said first guide member.

4. The bending machine of claim 3, wherein said second guide member has a curvilinear profile and is shaped so as to define a center of curvature located on the first side of the material feed axis.

5. The bending machine of claim 4, further including:

a plurality of tool mounting carriages mounted to said first guide member, each said tool mounting carriage being selectively positioning along the length of said first guide member.

6. The bending machine of claim 2, further including:

third guide member having an elongated profile secured to said face of said body; and a tool mounting carriage selectively mounted to said third guide member for being selectively positionable along the length of said guide member.

7. The bending machine of claim 1 wherein said first guide member has a circular profile.

8. The bending machine of claim 4 wherein said first and second guide members each has a circular profile.

9. The bending machine of claim 2, wherein said first guide member is formed so that the center of curvature thereof is located on the second side of the material feed axis at a point distal to the outer edge of said second guide member.

10. The bending machine of claim 4, wherein: said first guide member is formed so that the center of curvature thereof is located on the second side of the material feed axis at a point distal to the outer edge of said second guide member; and said second guide member is formed so that the center of curvature thereof is located on the second side of the material feed axis at a point distal to the outer edge of said first guide member.

11. The bending machine of claim 3, further including:

a conveyor assembly secured to said body adjacent said first guide member, said conveyor assembly having a first coupling element positioned to travel the length of said first guide member and a drive assembly positioned to selectively locate said first coupling element along said first guide member;

a second coupling element attached to each said tool mounting carriage mounted to said first guide member, said second coupling elements adapted to be selectively engagable with said first coupling element so that when each said second coupling element is so engaged, actuation of said drive assembly will result in selective displacement of said tool mounting carriage with which said second coupling element is associated; and a clamping device attached to each said tool mounting carriage, each said clamping device adapted to be selectively engaged with said first guide member so as to secure said tool mounting carriage with which said clamping device is associated to said first guide member, said clamping device being further configured so as to disengage from said securing position when said second coupling element of said associated tool mounting carriage engages said first coupling element of said conveyor assembly.

12. A bending machine for selectively shaping an elongated workpiece, said machine including:

a frame defining a face across which the workpiece is positioned along a material feed axis, the material feed axis defining two opposed sides therealong;

first and second guide members secured to said frame, said guide members being secured to said frame so that each said guide member is positioned on a separate one of the sides of the material feed axis and, wherein, said guide members are formed to have curvilinear profiles and each said guide member is shaped to define a center of curvature that is located on the side of the material feed axis opposite the side of the material feed axis on which said guide member is located; and at least three tool mounting carriages, each said tool mounting carriage constructed for carrying a workpiece shaping tool, two said tool mounting carriages being mounted to said first guide member for being selectively positionable along the length thereof and said third tool mounting carriage being mountable to said second guide member for being selectively positionable along the length thereof.

13. The bending machine of claim 12, wherein: said first guide member is formed so that the center of curvature thereof is located at a point distal to the outer edge of said second guide member; and said second guide member is formed so that the center of curvature thereof is located at a point distal to the outer edge of said first guide member.

14. The bending machine of claim 12, further including:

a conveyor assembly secured to said frame adjacent said first guide member, said conveyor assembly having a first coupling element positioned to travel the length of said first guide member and a drive assembly positioned to selectively position said first coupling element along side first guide member; and a second coupling element attached to each said tool mounting carriage mounted to said first guide member, said second coupling elements adapted to be selectively engagable with said first coupling element so that when each said second coupling element is so engaged, actuation of said drive assembly will result in selective displacement of said tool mounting carriage associated with said engaged second coupling element.

15. The bending machine of claim 14, further including a clamping device attached to each said tool mounting carriage mounted to said first guide member, each said clamping device adapted to be selectively engaged with said first guide member so as to secure said tool mounting carriage with which said guide member is associated in position on said first guide member, said clamping device being further configured so as to disengage from said securing position with when said second coupling element of said associated tool mounting carriage engages said first coupling element of said conveyor assembly.

16. The bending machine of claim 12, further including:

third guide member having an elongated profile secured to said frame; and a tool mounting carriage selectively mounted to said third guide member for being selectively positionable along the length of said guide member.

17. The bending machine of claim 16, wherein said third guide member extends across both sides of the material feed axis.

18. The bending machine of claim 1, wherein said third guide member has a curvilinear profile.

19. The bending machine of claim 12, wherein said first and second guide members each has a circular profile.

20. The bending machine of claim 13, wherein said first and second guide members each has a circular profile.

* * * * *

UNITED STATES PATENT AND TRADEMARK OFFICE

CERTIFICATE OF CORRECTION

PATENT NO. : 5,542,283
DATED : August 6, 1996
INVENTOR(S) : Friedhelm POST

It is certified that error appears in the above-indentified patent and that said Letters Patent is hereby corrected as shown below:

Column 8, line 35; change "Claim 1" to ---Claim 17---.

Signed and Sealed this

Eighteenth Day of February, 1997

*Attest:*

*Attesting Officer*

BRUCE LEHMAN

*Commissioner of Patents and Trademarks*